US011141040B2

(12) United States Patent
Neumann

(10) Patent No.: US 11,141,040 B2
(45) Date of Patent: Oct. 12, 2021

(54) DISH CLEANING BRUSHES

(71) Applicant: EASY-DO PRODUCTS LIMITED, North Finchley (GB)

(72) Inventor: Daniel Neumann, North Finchley (GB)

(73) Assignee: LIBMAN BRANDS UK LTD.

( * ) Notice: Subject to any disclaimer, the term of this patent is extended or adjusted under 35 U.S.C. 154(b) by 0 days.

(21) Appl. No.: 16/606,186

(22) PCT Filed: Apr. 13, 2018

(86) PCT No.: PCT/EP2018/059599
§ 371 (c)(1),
(2) Date: Oct. 17, 2019

(87) PCT Pub. No.: WO2018/197239
PCT Pub. Date: Nov. 1, 2018

(65) Prior Publication Data

US 2020/0121160 A1 Apr. 23, 2020

(30) Foreign Application Priority Data

Apr. 26, 2017 (GB) ..... 1706659

(51) Int. Cl.
*A46B 3/00* (2006.01)
*A46B 5/00* (2006.01)
(Continued)

(52) U.S. Cl.
CPC ..... *A47L 17/04* (2013.01); *A46B 3/005* (2013.01); *A46B 3/04* (2013.01); *A46B 5/0029* (2013.01);
(Continued)

(58) Field of Classification Search
CPC ..... A46B 3/005; A46B 5/0029; A46B 5/0037; A46B 9/026; A46B 9/06; A46B 2200/3033; A46D 1/0207; A47L 17/04
See application file for complete search history.

(56) References Cited

U.S. PATENT DOCUMENTS

D387,704 S 12/1997 Berti ..... D32/45
5,966,771 A * 10/1999 Stroud ..... A46B 3/005 15/117
(Continued)

FOREIGN PATENT DOCUMENTS

GB 726943 3/1955
GB 787587 12/1957
(Continued)

OTHER PUBLICATIONS

Great Britain Search Report issued in application No. GB1706659.8, dated Aug. 1, 2017 (2 pgs).
(Continued)

*Primary Examiner* — Randall E Chin
(74) *Attorney, Agent, or Firm* — Hayes Soloway P.C.

(57) ABSTRACT

Disclosed is a hand-held dish cleaning brush that includes an elongate handle with a scrubbing head at one end, the scrubbing head including a working part of an elastomer integrally formed with a plurality of bristles and with a plurality of scraping projections that are formed as an array of scraping teeth, wherein the bristles are not directly aligned with but off-set from the scraping teeth and pass between the scraping teeth when flexed forwardly or rearwardly toward the scraping teeth.

20 Claims, 4 Drawing Sheets

(51) Int. Cl.

| | |
|---|---|
| ***A46B 9/06*** | (2006.01) |
| ***A47L 17/04*** | (2006.01) |
| ***A46B 3/04*** | (2006.01) |
| ***A46B 9/02*** | (2006.01) |
| ***A46D 1/00*** | (2006.01) |
| ***A46D 3/00*** | (2006.01) |

(52) U.S. Cl.

CPC ..... *A46B 5/0037* (2013.01); *A46B 9/026* (2013.01); *A46B 9/06* (2013.01); *A46D 1/0207* (2013.01); *A46D 3/005* (2013.01); *A46B 2200/3033* (2013.01)

(56) References Cited

U.S. PATENT DOCUMENTS

| | | | | |
|---|---|---|---|---|
| D446,898 | S | 8/2001 | Brewer | D32/45 |
| 6,463,618 | B1 * | 10/2002 | Zimmer | A46B 9/06 15/110 |
| D511,626 | S | 11/2005 | Hay | D32/45 |
| D540,543 | S | 4/2007 | Hay | D4/118 |
| D586,680 | S | 2/2009 | Bober | D10/101 |
| D591,020 | S | 4/2009 | Dotterman | D32/35 |
| D600,025 | S | 9/2009 | Hill | D32/45 |
| D770,116 | S | 10/2016 | Neumann | D32/45 |
| D770,117 | S | 10/2016 | Neumann | D32/45 |
| D770,712 | S | 11/2016 | Neumann | D32/45 |
| D828,969 | S | 9/2018 | Brady | D32/40 |
| D845,001 | S * | 4/2019 | Jack | D4/130 |
| D858,019 | S | 8/2019 | Gooden | D32/45 |
| D858,020 | S | 8/2019 | Gooden | D32/45 |
| 2004/0158948 | A1 | 8/2004 | Sander et al. | 15/188 |
| 2011/0047736 | A1 | 3/2011 | Jimenez et al. | 15/167.2 |
| 2011/0138560 | A1 * | 6/2011 | Vitt | A46B 15/0081 15/167.1 |
| 2012/0030891 | A1 * | 2/2012 | Bauernfeind | A46B 9/026 15/167.1 |

FOREIGN PATENT DOCUMENTS

| | | | |
|---|---|---|---|
| JP | 2009240768 | 10/2009 | A46B 3/22 |
| WO | WO2012083489 | 6/2012 | A46B 7/06 |
| WO | WO2012104162 | 8/2012 | A61H 7/00 |
| WO | WO 103614-001 | 11/2018 | |

OTHER PUBLICATIONS

International Search Report and Written Opinion issued in application No. PCT/EP2018/059599, dated Jul. 13, 2018 (8 pgs).

Notice of Allowance issued in U.S. Appl. No. 29/688,364, dated Oct. 8, 2020 (8 pgs).

Sudser Scour n' Spong Dishwashing Brush, Lola Products website 2020, https://lolaproducts.com/products/sudser-scour-n-sponge-dishwashing-brush-506?gclid=Cj (dated Sep. 30, 2020).

* cited by examiner

DISH CLEANING BRUSHES

TECHNICAL FIELD

The present invention concerns improvements primarily in and relating to hand held dish cleaning brushes, also known colloquially as 'washing-up' brushes, such as are used for cleaning cookware and dinnerware to remove food residue and including tough baked-in residue on dishes and pans.

BACKGROUND ART

The general design of dish-cleaning brushes for cleaning cookware and dinnerware has altered relatively little over the years. As shown in FIG. 1, the standard form of dish cleaning brush 1 comprises an elongate handle 2 that is generally designed to be long enough to be able to reach into the depths of a washing up bowl or basin that is in use full of hot, soapy water and items to be cleaned. The handle 2 has a grip area for the user's hand along the handle at its proximal end and a scrubbing head 3 at the other end (distal end). The scrubbing head 3 bears an array of inserted bristles 5. The distal end of the handle 2 and head 3 is inclined at an angle θ to the main/proximal length of the handle 2 to facilitate application of substantial manual handling pressure via the handle down through the head 3 and bristles 5 onto the grime-covered surface of a dish or pan to be cleaned.

The bristles 5 in the scrubbing head 3 are commonly in rows transverse to the longitudinal axis of the head 3 and handle 2, as illustrated in the example shown in FIG. 1. Other common arrays are of rows forming substantially concentric rings of bristles at the head. The handle 2 and head 3 are commonly injection moulded of a thermoplastic material such as polyethylene or polypropylene and in most cases the head and handle are commonly formed as one piece or in some cases as two pieces, for example to allow inter-change of heads on a handle as per the example shown in FIG. 1. The bristles 5 are generally tough nylon filaments that are mounted to the head individually or in multiple bundles in a multi-step manufacturing process to project from the head.

Commonly the bristles 5 are formed by extrusion of nylon filaments that are cut to standard short lengths and transported to an assembly bay, folded in two at mid-length, bundled together and stapled into individual receiving sockets for the bundles of bristles 5 that are sunk in the cleaning face of the head.

The head and handle are generally substantially rigid while the nylon bristles are necessarily robust but fairly flexible and able to bend when used in a scrubbing action, e.g. in a reciprocating or circling action, firmly pressed down onto the grime-covered surface of the item being cleaned. The nature of flexure of the bristles is generally defined within parameters that suit the use of the brush, with the bristles flexing enough under normal scrubbing pressure and motion that the brush remains intact and does not damage the item being cleaned while still being stiff enough to effectively shift ingrained/baked-in grime. This basic design has served well for decades but it has its problems, not least including the substantial cost of the multi-step head and bristle formation and assembly process and also having inherent structural and functional limitations of its standard design.

In recent years there have been advances in the materials and design of brushes for other much more low impact purposes, such as gentle exfoliating and hair grooming brushes, soft bottle brushes and floor sweeping brushes and brooms. Such advances include the use of soft, resilient elastomer for the bristles and allowing one step moulding of a brush head portion with integral bristle filament projections rather than separately formed inserted individual bristles. These are, however, as noted generally for low impact uses that are relatively benign to the soft elastomeric filaments and to the target surface, involving a combing, sweeping or wiping action but not involving any combined substantial downward handling pressure through the handle and vigorous scrubbing type action, unlike dish cleaning brushes need to do for cleaning cookware/dishes to remove food residue and baked-in cooking residue.

It is a general object of the present invention to provide an innovative dish-cleaning brush that offers a substantial change from the conventional designs, and mechanics of operation of dish-cleaning brushes and that can provide cost economies in manufacture.

DISCLOSURE OF INVENTION

According to the present invention there is provided a hand-held dish cleaning brush that comprises an elongate handle with a scrubbing head at a distal end, the scrubbing head including a working part of an elastomer integrally formed with a plurality of bristles and with a plurality of scraping projections that are formed as an array of scraping teeth, wherein the bristles are not directly aligned with but off-set from the scraping teeth and pass between the scraping teeth when flexed forwardly or rearwardly toward the scraping teeth.

This arrangement obviates any risk of potential damage from a bristle bending back onto an edge of a scraping tooth in use.

Preferably the bristles and scraping teeth nearer the front/distal end of the brush are longer than those farther away from the front/distal end of the brush. The bristles and scraping teeth may be of progressively shorter length the greater their distance from the front/distal end of the brush.

Preferably the elastomer is a thermoplastic elastomer, for example a thermoplastic copolymer.

As is normal with dish-cleaning brushes, the handle of the brush is suitably not aligned with the scrubbing head and orthogonal to the bristles. It is off-set at an angle. That is, the distal end of the handle and working part of the head is preferably oriented at an angle to the main length and proximal end of the handle of the brush in order to facilitate application of substantial manual handling pressure onto the handle and thereby through the head. That is, the scrubbing head is preferably oriented at an angle θ to the main/longitudinal axis of the handle. The angle θ is suitably of the order of 15 to 40 degrees and preferably about 30 to 35 degrees.

The bristles serve to provide a wiping/brushing cleaning action and they are preferably at least partially protected by and augmented by at least one scraping projection. By forming the scraping projection as a more robust/less flexible broader projection shielding the relatively softer elastomeric/TPE/TPC bristles, the elastomeric bristles are less vulnerable to risk of damage in use.

The scrubbing teeth may be less flexible, broader projections than the bristles.

Preferably one or more scraping projections are positioned on the brush forward of the bristles, i.e. closer to the distal end of the brush (the distal end being the end of the handle remote from the user's hand and that carries the scrubbing head) than some or all of the bristles. Preferably the scraping teeth are interspersed among the bristles. Preferably the scraping teeth are in rows. In some preferred embodiments the scraping teeth are transverse, preferably substantially perpendicular, to a longitudinal axis of the elongate handle and scrubbing head.

Preferably scraping teeth alternate with bristles longitudinally of the brush. A row of scraping teeth may be substantially parallel to a row of bristles.

Preferably the cleaning dish is generally flexible. The dish cleaning brush may have an undulating form, for example a substantially sigmoidal (S-shaped form), in side view.

The bristles are generally flexible filamentous projections from the head. The bristles suitably have a generally rounded form in cross-section, preferably being substantially circular cylindrical in form. The scraping teeth are preferably projections from the head that are less flexible than the bristles and relatively more plate-like in form, presenting an elongate scraping end form/edge.

The scraping teeth are preferably substantially shorter than adjacent bristles. The scraping teeth are suitably generally substantially all substantially broader than the bristles, being of a larger cross-sectional area and relatively flattened/planar, for example not circular in cross section. For many embodiments they are wider/of greater spread laterally/transverse of the longitudinal axis of the brush/handle than they are longitudinally of the brush/handle.

The currently preferred materials for the scrubbing brush are for the scrubbing head to be moulded of Hytrel® TPC and for the handle to be moulded of ABS.

The currently preferred method of manufacture is a twin shot injection moulding process. Preferably this entails over-moulding the scrubbing head directly onto the handle in the moulding machine.

Figure 1:
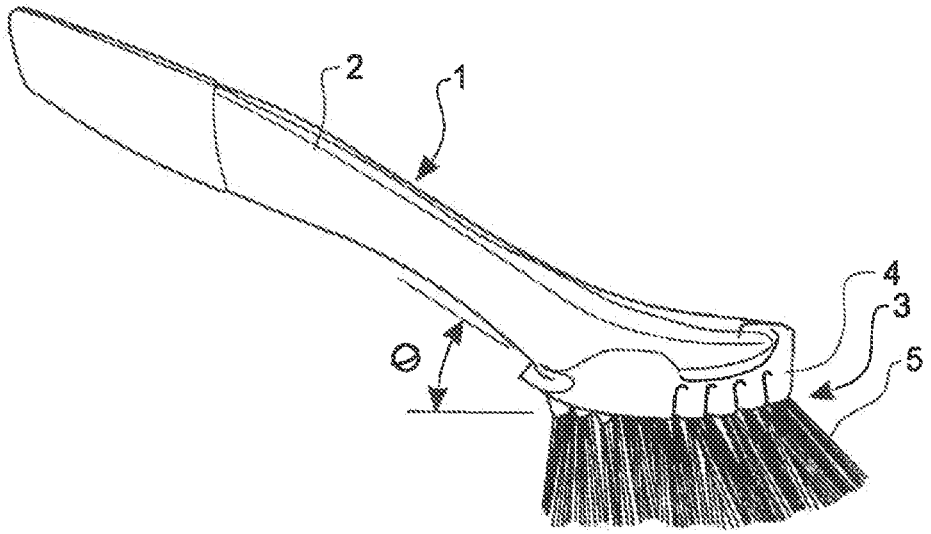
Fig. 1 PRIOR ART
FIG. 1 [Prior Art] is a side elevation view of one of the applicant's own current designs of dish-cleaning brushes as an example of the general form of existing dish-cleaning brushes.
Figure 2:
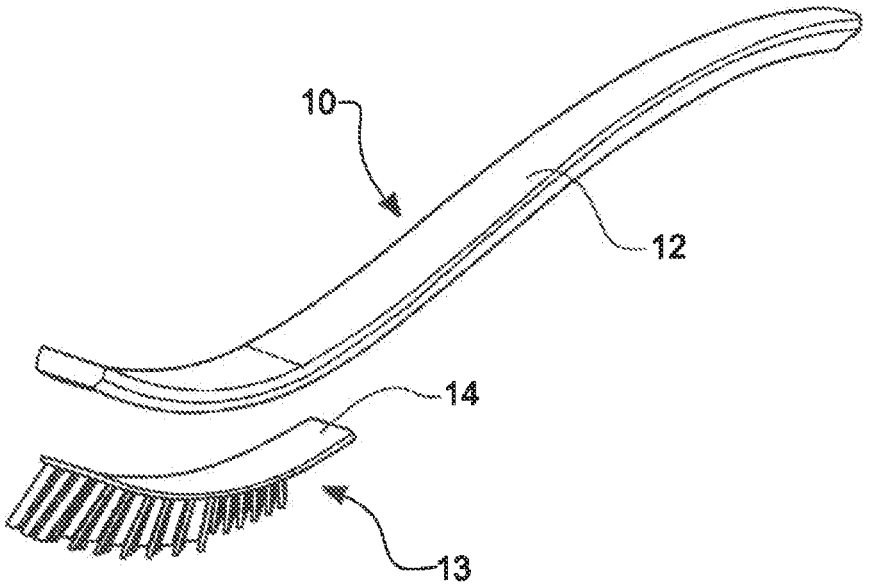
Figure 3:
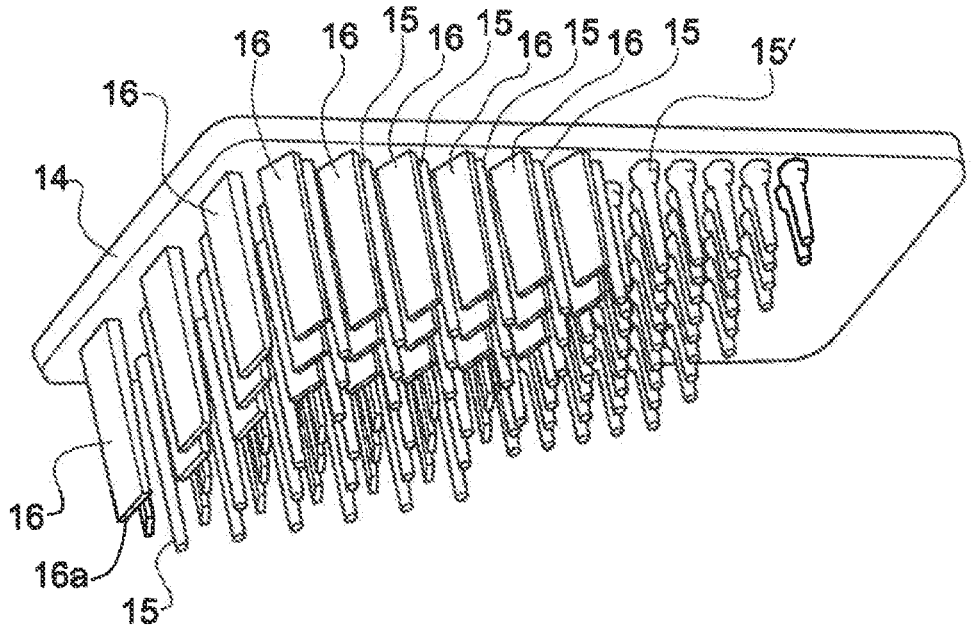
Figure 4:
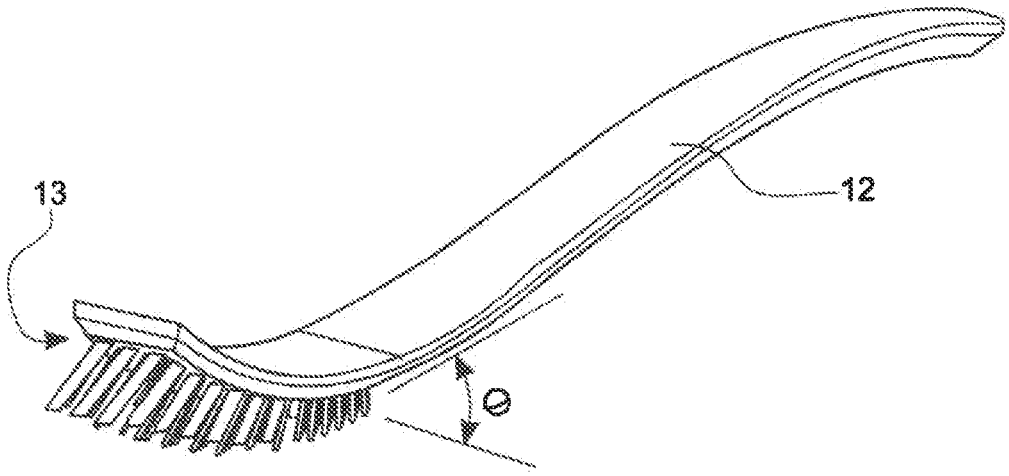
Figure 5:
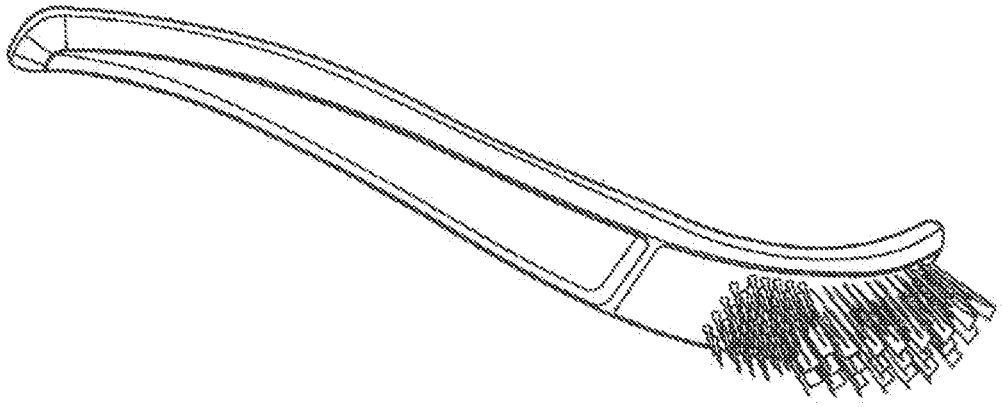
Figure 6:
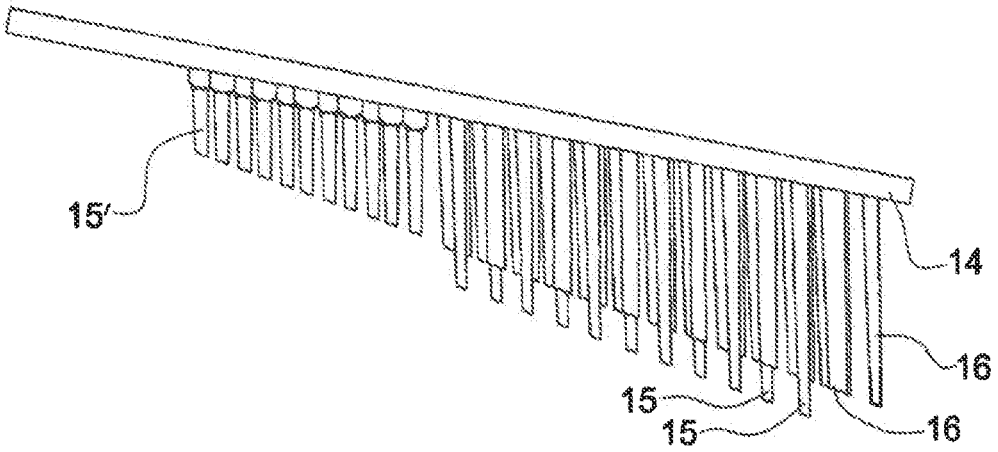
Figure 7:
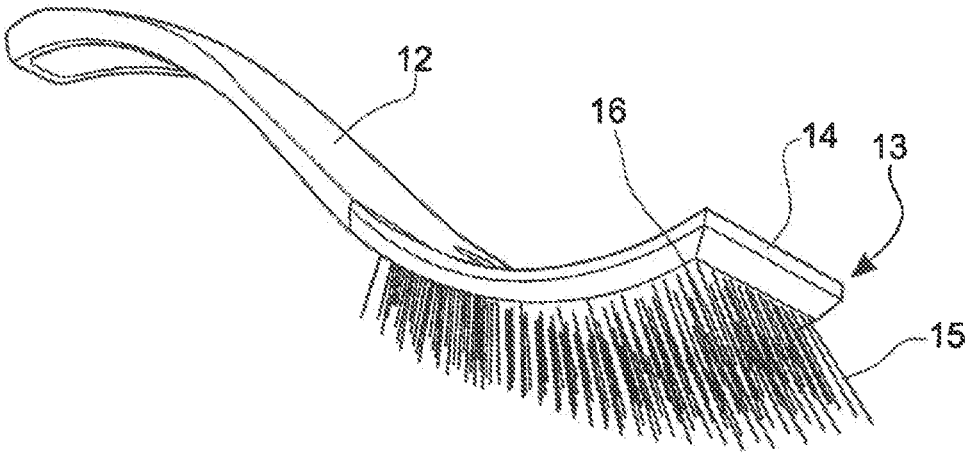
Figure 8:
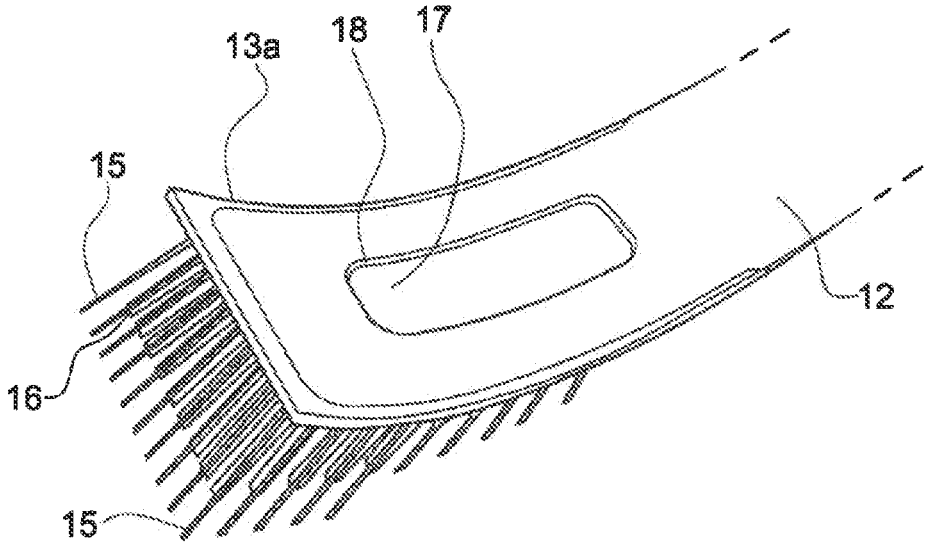

A preferred embodiment of the invention will now be more particularly described, solely by way of example, with reference to the accompanying drawings in which:

FIG. 2 is a perspective view of a two part first preferred embodiment of the dish-cleaning brush from one side and showing the scrubbing head with integrally formed bristles and teeth prior to final assembly to a separately moulded handle;

FIG. 3 is a perspective view from below showing the scrubbing head in greater detail;

FIG. 4 is a perspective view corresponding to FIG. 2, showing the assembled dish-cleaning brush;

FIG. 5 is a perspective view from below of the assembled dish-cleaning brush;

FIG. 6 is a side elevation view of the FIG. 3 scrubbing head more clearly showing the greater length of the bristles;

FIG. 7 is a perspective view of a variant of the first preferred embodiment of the dish-cleaning brush where the scrubbing head with integrally formed bristles and teeth is over-moulded onto the handle; and FIG. 8 is a perspective view from above of the head end of the FIG. 7 variant of the brush.

MODE(S) FOR CARRYING OUT THE INVENTION

The present embodiments represent currently the best ways known to the applicant of putting the invention into practice but are not the only ways in which this can be achieved. They are illustrated, and they will now be described, by way of example only.

The illustrated first preferred embodiment of hand-held dish cleaning brush

10 of the invention shown in FIGS. 2 to 6 comprises two major parts 12, 13 that are moulded and assembled together to form the brush 10.

Firstly the brush 10 comprises a sigmoidal (S-shaped) handle 12 that is injection moulded as a single piece, suitably from ABS. The handle 12 is generally thinner, i.e. more planar, than the conventional dish cleaning brush handles 2 and it is not completely rigid but it has an inherent moderate flexure, again unlike conventional dish cleaning brush handles. The handle 12 may incorporate a contoured or roughened pattern or other modification to its surface nearer the proximal end to aid grip in the user's hand, and a hanging aperture may be provided at the proximal end tip of the handle.

The second major part of the dish cleaning brush 10 is a scrubbing head 13 that is injection moulded as a single piece from an elastomer such as TPE (thermoplastic elastomer), TPC (thermoplastic copolyester) which is a more specific form of TPE, or polypropylene. The preferred TPE is a TPC manufactured by DuPont and known as Hytrel® although other TPEs such as TPU may be used. The scrubbing head 13 is moulded as a substantially planar rectangular base plaque 14 that has a plurality of integrally formed projections 15, 16 projecting from one face (outer face in use) while the obverse face of the plaque 14 is generally smooth and adapted to be offered up to the underside of the distal end of the handle 12 to be adhered or thermally welded in place to the handle 12. The planar rectangular base plaque 14 is suitably about 2 mm thick and formed flat but is somewhat flexible and able to flex to facilitate mounting to the convex curvature of the underside of the distal end of the handle 12 and is able to contribute to resilient flex of the brush as a whole in use.

The integral TPE projections 15, 16 from the TPE plaque 14 are of two general types. Some are bristles 15 while others are scraping teeth 16. The bristles 15 of the brush 10 are not individual filaments that need to be inserted into the scrubbing head 13 but are integrally moulded as part of the head 13. They are filamentous in form. They are generally substantially circular cylindrical, elongate and flexible. The bristles 15 are arranged in substantially parallel rows that span the width of the scrubbing head 13 and they serve in use to brush and wipe loose grime from the saucepan, frying pan, dish, grille or other item of dinnerware or cookware being cleaned.

The bristles 15 are, as illustrated, graded in length. The longest bristles 15 are those of the first row of bristles 15 at the very front/distal end of the brush 10 while those of the row immediately behind are shorter and so on. This provides the user with greater control over action of the dish cleaning brush. For example, by tilting the brush handle 12 to press down more on the rear bristle 15 rows of the scrubbing head 13 the user is able to take advantage of the greater stiffness/reduced flex of the shorter bristles 15 there to press more firmly into stubborn grime.

As can be seen in FIG. 3 the rows of bristles 15 are not straight rows but rather are angled back to each side of the longitudinal axis of the brush 10/handle 12 so that the pattern of the bristles 15 is as a chevron if viewed in plan. This aids the driving of the brush 10 through grime when the brush 10 is pushed forwards and it enhances capture of grime as the brush 10 is then moved rearwardly. The various angles of the bristles 15 and scraping teeth 16 are all selected to allow for ready de-moulding in a common pulling direction.

The scraping teeth 16 are, like the bristles 15, integrally formed TPE projections from the TPE base plaque 14 that are moulded in the process of injection moulding the scrubbing head 13. Although also formed as TPE projections the scraping teeth 16 are of substantially different shape and nature to the bristles 15. The scraping teeth 16 are not filamentous, but broad and relatively more stiff than the bristles 15 and each scraping tooth 16 presents a scraping edge 16*a* at its outer/free end. The scraping teeth 16 are generally substantially broader than the bristles 15, being of the order of four or five times broader, e.g. 5 mm wide as compared to approximately 1 mm diameter bristles. The scraping teeth 16 are relatively flattened/planar, not circular in cross section, and are generally of a larger cross-sectional area than the bristles. They are generally wider/of greater spread laterally/across the brush 10 transverse of the longitudinal axis of the brush 10/handle 12 than they are longitudinally of the brush 10/handle 12. In preferred examples the scraping teeth 16 are approximately 5 mm wide by 2 mm thick and the longest of the scraping teeth 16 are suitably of the order of 30 mm long.

The scraping teeth 16 are provided in an array of rows that extend transversely across the brush 10 generally parallel to the rows of bristles 15. As can be seen from FIG. 3, the front two rows of projections at the front/distal end of the brush 10 are scraping teeth 16, and they provide protection to the rows of bristles 15 behind them and provide a frontline of scraping attack on the grime being removed. The successive rows of scraping teeth 16 alternate with rows of bristles 15. The third row from the front end is thus a row of bristles 15, the fourth row is a row of scraping teeth 16 and the fifth row is a row of bristles 15 and so on.

The scraping teeth 16 are all generally a bit shorter, e.g. 2 or 3 mm shorter, than the corresponding bristles 15 that they are adjacent to on the brush head 13. Like the bristles 15, the scraping teeth 16 are arranged in graded height with the front row of scraping teeth 16 nearest to the front/distal end of the brush 10 being longest while those of the row immediately behind are shorter and so on; each successive row rearwardly being progressively of shorter and shorter length. At the rear end of the head 13 are several rows exclusively of modified short toughened bristles 15', not alternating with rows of scraping teeth 16. These toughened bristles 15' each have a thickened/buttressed base at their emergence from the plaque 14 and they are all relatively short, being on average half the length of the bristles 15 of the front row and are guarded from the front end of the brush head 13 by the many rows of scraping teeth 16.

Turning to FIGS. 7 and 8, these show a variant of the first embodiment in which the TPE scrubbing head 13 is over-moulded onto a polypropylene handle 12 (rather than ABS handle 12). The scrubbing head 13 is firmly held in place mechanically by inter-fit at an extended upper rim 13*a* of the head 13 which embraces the perimeter of the distal end of the handle 12. The preferred TPE, Hytrel®, does not generally bond wholly effectively to polypropylene and so the measures for inter-fitting of the plaque 14 of scrubbing head 13 to the distal end of handle 12 ensure robust assembly. A further element adding to mechanical inter-fit/coupling of the head 13 and handle 12 is an integral mushroom fitting projection 17 projecting from the upper face of the plaque 14 of the scrubbing head 13. The stem of the mushroom fitting 17 passes through a slot 18 through the handle 12 for the enlarged head of the mushroom fitting 17 to engage and hold the scrubbing head 13 in place on the handle 12.

Also notable in the FIGS. 7 and 8 variant as a departure from the design in FIGS. 2 to 6 is the provision of the bristles 15 in a differing configuration. Inter alia in this variant there is an extra row of bristles 15 at the very, front of the scrubbing head 13 forward of the initial row of scraping teeth 16.

From the fore-going it will be appreciated that the present invention addresses limitations of the prior art and provides a dish-cleaning brush that is more compact, more flexible and versatile and with substantial economies in manufacture.

Although the invention is described hereinabove by way of example with respect to one preferred embodiment a wide range of other embodiments are conceivable within the scope of the invention. Novel features of any variant may be combined with features of any other variant.

The currently preferred manufacturing process for making the brush of the present invention entails twin-shot moulding, that is to say complex moulding from two different polymers at the same time during one machine cycle. In the present case the preferred process is an over-moulding twin-shot injection moulding process where the ABS handle is moulded as a first shot and the TPE scrubbing head is moulded as a second shot straight onto the moulded ABS handle. In an alternative in-mould assembly approach the handle and scrubbing head may be moulded separately and joined together in-mould with heat applied to weld and secure the scrubbing head moulding to the handle moulding. However the brush is assembled, in all cases it is generally far simpler and more cost-efficient to manufacture than the existing dish-cleaning brushes.

The invention claimed is:

1. A hand-held dish cleaning brush that comprises an elongate handle with a scrubbing head at a distal end, the brush having a distal end furthest from the handle and a proximal end furthest from the scrubbing head and the brush having a longitudinal axis running between the distal and proximal ends of the brush, the scrubbing head including a working part of an elastomer integrally formed with a plurality of bristles and with a plurality of scraping projections that are formed as an array of scraping teeth, wherein the bristles are not directly aligned with the scraping teeth along the longitudinal axis of the brush but off-set from the scraping teeth, the bristles and the scraping projections being arranged such that the bristles pass between the scraping teeth when the bristles are flexed longitudinally towards the scraping teeth along the longitudinal axis of the brush.

2. The hand-held dish cleaning brush as claimed in claim 1, wherein the bristles and scraping teeth nearer the front/distal end of the brush are longer than those farther away from the front/distal end of the brush.

3. The hand-held dish cleaning brush as claimed in claim 2, wherein the bristles and scraping teeth are progressively of shorter length the greater their distance from the front/distal end of the brush.

4. The hand-held dish cleaning brush as claimed in claim 1, wherein the elastomer is a thermoplastic elastomer.

5. The hand-held dish cleaning brush as claimed in claim 4, wherein the elastomer is a thermoplastic copolymer.

6. The band-held dish cleaning brush as claimed in claim 1, wherein the distal end of the handle and working part of the head is oriented at an angle to the main length and proximal end of the handle of the brush in order to facilitate application of substantial manual handling pressure onto the handle and thereby through the head.

7. The hand-held dish cleaning brush as claimed in claim 1, wherein the bristles are at least partially shielded by at least one scraping projection.

8. The hand-held dish cleaning brush as claimed in claim 1, Wherein the scraping teeth are less flexible, broader projections than the bristles.

9. The hand-held dish cleaning brush as claimed in claim 1, wherein one or more scraping projections are positioned on the brush forward of the bristles, closer to the distal end of the brush than some or all of the bristles.

10. The hand-held dish cleaning brush as claimed in claim 1, wherein the scraping teeth are interspersed among the bristles.

11. The hand-held dish cleaning brush as claimed in claim 1, Wherein the scraping teeth are in rows.

12. The band held dish cleaning brush as claimed in claim 1, wherein the scraping teeth alternate with the bristles longitudinally of the brush.

13. The hand-held dish cleaning brush as claimed in claim 1, wherein a row of scraping teeth is substantially parallel to a row of bristles.

14. The hand-held dish cleaning brush as claimed in claim 1, wherein the dish cleaning brush is generally flexible.

15. The hand-held dish cleaning brush as claimed in claim 1, wherein the dish cleaning brush has an undulating form in side view.

16. The hand-held dish cleaning brush as claimed in claim 15, wherein the dish cleaning brush has a substantially sigmoidal (S-shaped) form in side view.

17. The hand-held dish cleaning brush as claimed in claim 1, wherein the scraping teeth are projections from the head that are less flexible than the bristles and presenting an elongate scraping form/end edge.

18. The hand-held dish cleaning brush as claimed in claim 1, wherein the scraping teeth are substantially shorter than adjacent bristles.

19. The hand-held dish cleaning brush as claimed in claim 1, wherein the scraping teeth are generally substantially broader than the bristles, being of a large cross-sectional area and relatively flattened/planar.

20. The hand-held dish cleaning brush as claimed in claim 1, wherein the scraping teeth are wider/of greater spread laterally/transverse of the longitudinal axis of the brush/handle than they are longitudinally of the brush/handle.

* * * * *